US006381199B1

(12) United States Patent
Kröner et al.

(10) Patent No.: US 6,381,199 B1
(45) Date of Patent: Apr. 30, 2002

(54) DEVICE FOR ELECTRICALLY CONNECTING AN ELECTRICAL POWER SOURCE AND AN ELECTRONIC CIRCUIT OF A TIMEPIECE

(76) Inventors: Wolfgang Kröner, Bekstrasse 42, D-75180, Pforzheim (DE); Markus Kaiser, Leopoldstrasse 6, CH-4500, Solothurn; Renato Schneider, Gurnigelstrasse 34, CH-2560, Nidau, both of (CH)

( * ) Notice: Subject to any disclaimer, the term of this patent is extended or adjusted under 35 U.S.C. 154(b) by 43 days.

(21) Appl. No.: 09/655,011

(22) Filed: Sep. 5, 2000

(30) Foreign Application Priority Data

Sep. 7, 1999 (CH) ..... 1621/99

(51) Int. Cl.[7] ..... G04C 23/12; H01R 4/00

(52) U.S. Cl. ..... 368/203; 368/204; 368/88; 439/500

(58) Field of Search ..... 368/203, 204, 368/88, 276; 439/500, 501, 504, 506

(56) References Cited

U.S. PATENT DOCUMENTS 2,907,810 A * 10/1959 Detwiler et al. ..... 439/500
2,985,704 A 5/1961 Kempf et al.
2,985,705 A 5/1961 Smythe
3,856,577 A * 12/1974 Oki et al. ..... 439/500
4,070,821 A * 1/1978 Somogyi ..... 368/204
4,107,400 A * 8/1978 Grohoski ..... 368/276
4,763,308 A * 8/1988 Morata ..... 368/88

FOREIGN PATENT DOCUMENTS

CH 471 415 A 4/1969
CH 615 070 A 1/1980
JP 2 671 838 7/1995

* cited by examiner

*Primary Examiner*—Diego Gutierrez
*Assistant Examiner*—Jeanne-Marguerite Goodwin
(74) *Attorney, Agent, or Firm*—Richard K. Robinson

(57) ABSTRACT

An electronic device is described, for a timepiece of electronic or electromechanical type, comprising a source of electrical power (4), such as a battery, an electronic circuit (3) and an electrical connector tongue (5) effecting an electrical connection between the source of electrical power and the electronic circuit. The electrical connector tongue (5) has first and second openings (55, 56) cooperating with a pair of fixing pins (25, 26) fixed to a support (2) of the said device, and further comprises a section (57) formed between the said openings (55, 56) and adapted to deform in an elastic manner so as to alter the spacing between the openings (55, 56) and allow engagement and retention of the electrical connector tongue (5) on the fixing pins (25, 26).

8 Claims, 2 Drawing Sheets

DEVICE FOR ELECTRICALLY CONNECTING AN ELECTRICAL POWER SOURCE AND AN ELECTRONIC CIRCUIT OF A TIMEPIECE

BACKGROUND OF THE INVENTION

The present invention relates to an electronic device for a timepiece of electronic or electromechanical type, comprising a source of electrical power, an electronic circuit and at least one electrical connector tongue effecting an electrical connection between the said source of electrical power and the said electronic circuit. The present invention also concerns an electrical connector tongue adapted to be mounted on a plate of an electronic or electromechanical timepiece, in order to effect an electrical connection between a source of electrical power and an electronic circuit of the timepiece.

Electromechanical or electronic timepieces usually comprise a resonator, for example of quartz, whose vibrations are maintained by an electronic control circuit supplied by a source of electrical power, such as a battery of button cell type. Electromechanical timepieces further comprise a timepiece movement controlled by the electronic control circuit associated with the resonator. The battery thus feeds the electronic circuit which maintains the vibrations of the resonator and, when applicable, supplies the drive pulses to a motor of the timepiece movement. In order that this battery may be connected to the electronic control circuit, electrical connecter means are provided to form a supply path.

These electrical connector means forming the supply path generally comprise two tongues for front and side electrical connection respectively, the first being positioned to come into contact with a first terminal (for example the negative terminal) of the battery, while the second is kept in contact with the second terminal (for example the positive terminal) of the battery.

These electrical connector tongues are typically fixed to a plate by conventional fixing means, by rivetting or by means of screws for example. This suffers from the problem of being relatively complex to assemble all the parts, especially during automated assembly. This type of fixing means furthermore makes it difficult to effect possible later replacement of such a tongue in a timepiece.

Moreover the use of fixing means constituted by screws, particularly on a plate of plastics material, can lead to problems of wear which add to the problems already mentioned.

SUMMARY OF THE INVENTION

The object of the present invention is thus to deal with the problems mentioned above by providing a device with electrical connector means whose structure and mode of fixing are simplified.

In order to address this object it is noted that electrical connector means for a timepiece have already been proposed in the patent JP 2 671 838 which do not require complex fixing means. The electrical connector means described in this patent comprise an electrical connector tongue guided by means of a pair of pins which cooperate with a pair of openings formed in the tongue. However, this electrical connector tongue is only held in place under the combined action of the battery and of the electronic circuit. In the absence of this action the tongue is liable to disengage from the pins, which can especially be a problem during fitting of the tongue or during a battery change.

The object of the present invention is thus further to provide a device comprising electrical connector means which do not require complex fixing means, such as screws or rivets, but which are nevertheless fixed in the timepiece in an adequate and reliable manner.

The invention further has the object of facilitating assembly and, if necessary, subsequent replacement of the electrical connector means in the timepiece.

To this end the present invention provides an electronic device for a timepiece of electronic or electromechanical type with the features set out in claim 1.

Other features of the present invention form the subject matter of the dependent claims.

The solution proposed by the present invention thus facilitates implementation and fitting of the electrical connector means in a timepiece, while ensuring that they are properly fixed.

The present invention also concerns a timepiece of electronic or electromechanical type comprising such a device, as well as an electrical connector tongue adapted to be mounted in an electronic or electromechanical timepiece, whose features are set out in claim 6.

Other features and advantages of the present invention will appear from a reading of the following description, given with reference to the accompanying drawings and solely by way of example, wherein:

DETAILED DESCRIPTION OF THE EMBODIMENT

Figure 1:
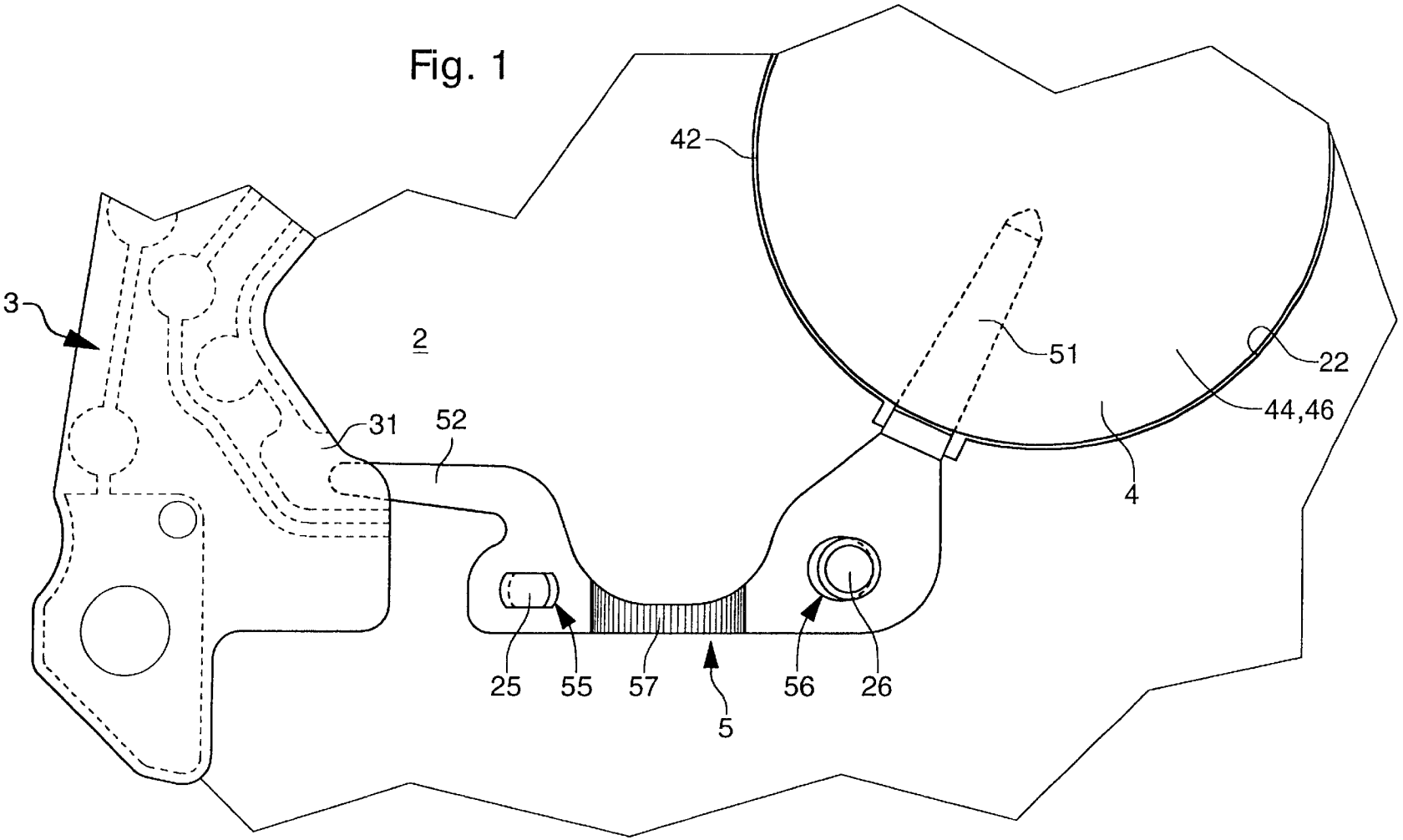
FIG. 1 is plan view of a portion of a timepiece comprising a plate, an electronic circuit, a source of power and electrical connector means including an electrical connector tongue according to the present invention.

Referring to the accompanying Figures, a timepiece is shown, comprising a plate 2 forming a support, advantageously made from a synthetic material such as an injection moulded plastic. The timepiece further comprises an electronic circuit 3, with which is associated a resonator, of quartz for example, not shown.

In the case of an electromechanical timepiece, it will further comprise a timepiece movement, implemented by a motor, such as a stepping motor, controlled by drive pulses from the electronic circuit 3. These parts do not form part of the subject matter of the present invention and have not been shown in the Figures.

In order to provide the supply to the electronic circuit 3 and, when applicable, to the motor, the timepiece is further fitted with a power source, formed in this example by a battery 4 of the button cell type. This battery 4 will provide the necessary electrical power for operation of the electronic circuit 3, which maintains the vibrations of the quartz resonator, and when applicable, supplies the motor of the timepiece movement.

This type of battery, such as the button cell 4, is of a widely marketed type and is used commonly in electronic and electromechanical timepieces. The battery 4 has an essentially cylindrical shape and has an edge or circumference 42 with the shape of part of a cylinder, bounded on one side and the other by two substantially flat regions of greater area, 44 and 46 respectively. One of these regions, in this example the region 46 facing the plate 2, and the cylindrical circumference 42 form the negative (–) and positive (+) terminals respectively of the battery 4. The battery 4 is placed in a cavity 22 formed in the plate 2, the negative terminal of the battery 4, namely the region 46, facing the bottom of this cavity 22.

In order to provide the supply to the electronic circuit 3, the timepiece comprises electrical connector means formed a feed path. These electrical connector means comprise in part a frontal electrical connector tongue 5 carried by the plate 2 and forming the negative part of the supply path. A first end part 51 of this electrical connector tongue 5 makes contact with the negative terminal 46 of the battery 4. A second end part 52 of the electrical connector tongue 5 makes electrical contact with a supply track 31 of the electronic circuit 3.

The electrical connector means further comprise a side electrical connector tongue, not shown, forming the positive part of the supply path. This part can be implement in conventional manner and lies within the realm of the man skilled in the art. However, it is noted that this side electrical connector tongue could equally be implemented according to the teaching of the present invention.

The electrical connector tongues can advantageously be implemented in the form of stamped metal plates, for example using a plate of spring steel.

The end parts 51 and 52 of the electrical connector tongue 5 are adapted to deform in an elastic manner under the action of the electronic circuit 3 and the battery 4, so that these end parts 51 and 52 will, after fitting, be kept in contact against the negative terminal 46 of the battery 4 and the feed track 31 of the electronic circuit 3. Thus, in FIG. 2, which is view in section of a portion of the timepiece, there is shown by way of example the position of the end part 51 of the frontal electrical connector tongue 5 in its position of rest, when the battery 4 is not fitted in the timepiece.

According to the present invention the frontal electrical connector tongue 5 further comprises a pair of openings 55 and 56 separated by a section 57 adapted to deform in an elastic manner and constituting part of the means fixing the tongue 5 on the plate 2. This section preferably has a profile substantially of an arc of a circle. The fixing means further comprise a pair of fixing pins 25 and 26 fixed to the plate 2, such as to maintain the frontal electrical connector tongue 5 in place in the timepiece.

The spacing of the openings 55 and 56 at rest is selected to be less than or greater than the corresponding spacing of the fixing pins 25 and 26. A smaller spacing of the openings 55 and 56 than that of the pins 25 and 26 implies that the section 57, once it is fitted on the plate, exerts a restoring force tending to close the openings 55 and 56 together. Accordingly the edges of the openings 55 and 56 located on the outside relative to the section 57 will make contact against the corresponding outside faces of the fixing pins 25 and 26.

Conversely, if a greater spacing of the openings 55 and 56 than that of the pins 25 and 26 is selected, once the tongue is fitted on the plate, it will exert a restoring force tending to spread the openings 55 and 56 apart. As a result the inner edges of the openings 55 and 56 will come into contact with the fixing pins 25 and 26. Regardless of the variant used, the section 57 thus ensures engagement and retention of the electrical connector tongue 5 on the fixing pins 25 and 26. The electrical connector tongue 5 is thus held in place without the assistance of a complementary action, such as a pressure exerted by the electronic circuit 3 or the battery 4.

The fixing pins 25 and 26 preferably have a substantially cylindrical shape and have respective radial indentations 25*a* and 26*a* in their lower parts, in which edges 55*a* and 56*a* respectively of the openings 55 and 56 of the tongue 5 engage, the elasticity of the section 57 ensuring that edges 55*a* and 56*a* of the openings 55 and 56 engage in the respective indentations 25*a* and 26*a* of the fixing pins 25 and 26. This design advantageously avoids accidental disengagement of the electrical connector tongue.

Pressure on the deformable section 57 of the tongue 5, here in a direction substantially perpendicular to the plane on which the tongue rests, causes the openings 55 and 56 to spread apart, allowing disengagement of edges 55*a* and 56*a* from the fixing pins 25 and 26.

Figure 2:
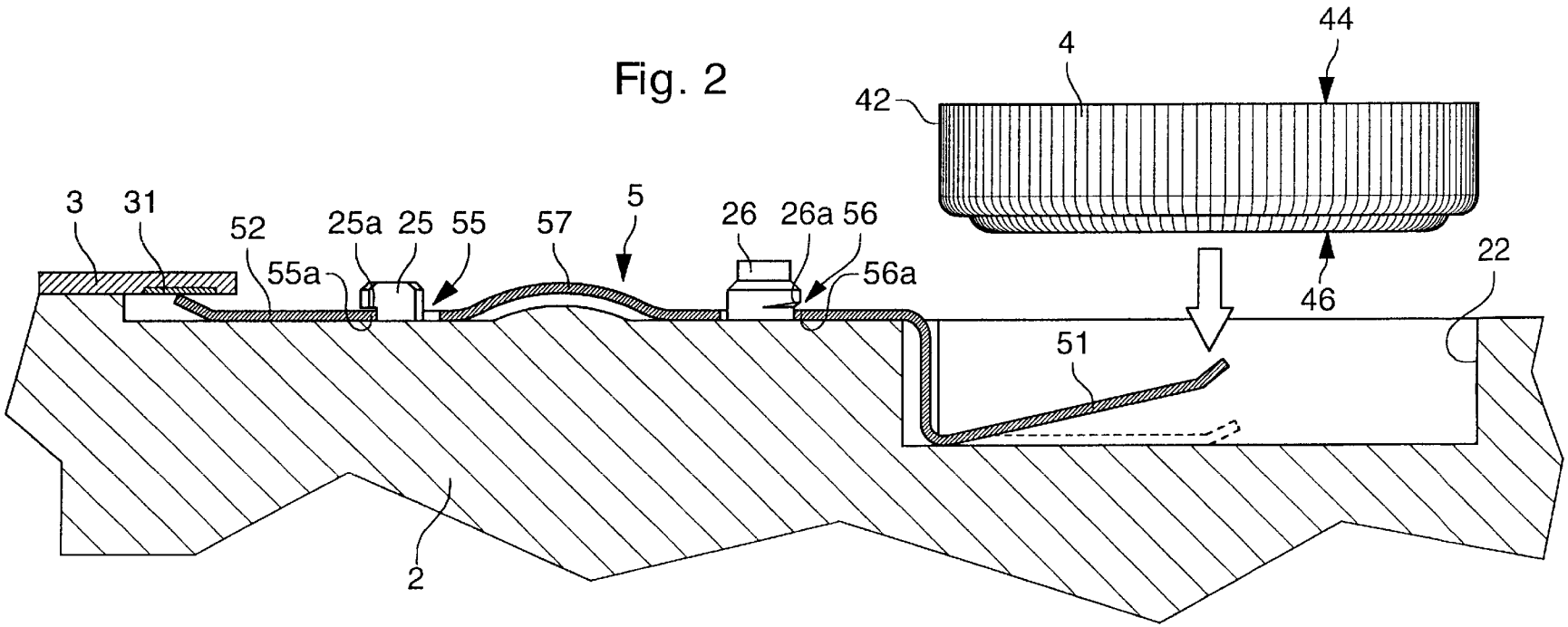
FIG. 2 is sectional view of the portion of the timepiece of FIG. 1, illustrating the electrical connector means according to the present invention.

In the example shown in FIG. 2, it will be seen that the section 57 can simply be formed in such a manner as to allow engagement of the tongue 5 on the fixing pins 25, 26, the retention of the tongue being effected essentially by the radial indentations 25*a*, 26*a* formed in the fixing pins. In this example, the section 47 thus contributes to retaining the tongue by forcing the sides 55*a*, 56*a* of the openings to enter the radial indentations 25*a*, 26*a*.

Many modifications and/or improvements can be introduced in the electrical connector tongue according to the present invention without departing from the scope and spirit thereof. It will in particular be understood that the present invention is not restricted only to application to a frontal electrical connector tongue such as has been described above, but can equally well be applied to the application of a side electrical connector tongue coming into contact with the positive terminal of the battery.

What is claimed is:

1. An electronic device for a timepiece of electronic or electro mechanical type, comprising a source of electrical power, an electronic circuit and at least one electrical connector tongue effecting an electrical connection between said source of electrical power and said electronic circuit, said electrical connector tongue having first and second openings cooperating respectively with first and second fixing pins fixed to a support of said device, wherein said electrical connector tongue further comprises a section formed between said first and second openings and adapted to deform in an elastic manner so as to alter a spacing between said first and second openings and allow engagement and retention of said electrical connector tongue on said first and second fixing pins.

2. The device according to claim 1, wherein at least one of said first and second fixing pins has a radial indentation in its lower part, in which an edge of a corresponding one of said first and second openings engages an upper part of said first and second fixing pins preventing accidental disengagement of the electrical connector tongue.

3. The device according to claim 1 or 2, wherein said section has a profile substantially of an arc of a circle.

4. The device according to claim 1, wherein said support is formed from plastic material and said electrical connector tongue is made from spring steel.

5. A timepiece of electronic or electro mechanical type comprising an electronic device including a source of electrical power, an electronic circuit and at least one electrical connector tongue effecting an electrical connection between said source of electrical power and said electronic circuit, said electrical connector tongue tongue having first and second openings cooperating respectively with first and second fixing pins fixed to a support of said device, wherein said electrical connector tongue further comprises a section formed between said first and second openings and adapted to deform in an elastic manner so as to alter a spacing between said first and second openings and allow engagement and retention of said electrical connector tongue on said first and second fixing pins.

6. An electrical connector tongue adapted to be fitted on a plate of an electronic or electro mechanical timepiece in order to effect an electrical connection between a source of electric power and an electronic circuit of said timepiece, this electrical connector tongue having first and second openings adapted to cooperate respectively with first and second fixing pins fixed to the plate of the timepiece, wherein said electrical connector tongue further comprises a section formed between said first and second openings and adapted to deform in at elastic manner so as to alter a spacing between said fist and second openings and allow engagement and retention of said electrical connector tongue on said first and second fixing pins.

7. The electrical connector tongue according to claim 6, wherein said section has a profile substantially of an arc of a circle.

8. The electrical connector tongue according to claim 6 or 7, wherein said electrical connector tonguer is made from spring steel.

* * * * *

UNITED STATES PATENT AND TRADEMARK OFFICE

CERTIFICATE OF CORRECTION

PATENT NO. : 6,381,199 B1
DATED : April 30, 2002
INVENTOR(S) : Wolfgang Kroner et al.

It is certified that error appears in the above-identified patent and that said Letters Patent is hereby corrected as shown below:

Title page,
Item [73], insert to read:
-- ETA SA Fabriques D'Ebauches, Switzerland --

Signed and Sealed this

Eighth Day of October, 2002

*Attest:*

*Attesting Officer*

JAMES E. ROGAN
*Director of the United States Patent and Trademark Office*